US008902039B2

(12) United States Patent
Suzuki et al.

(10) Patent No.: US 8,902,039 B2
(45) Date of Patent: Dec. 2, 2014

(54) NON-LINEAR RESISTIVE ELEMENT

(71) Applicant: Otowa Electric Co., Ltd., Osaka (JP)

(72) Inventors: Toshihiko Suzuki, Amagasaki (JP); Yoshimasa Tsujimoto, Amagasaki (JP); Naoyuki Tsukamoto, Amagasaki (JP)

(73) Assignee: Otowa Electric Co., Ltd., Osaka-Shi (JP)

( * ) Notice: Subject to any disclaimer, the term of this patent is extended or adjusted under 35 U.S.C. 154(b) by 0 days.

(21) Appl. No.: 14/119,989

(22) PCT Filed: Mar. 28, 2013

(86) PCT No.: PCT/JP2013/059245
§ 371 (c)(1),
(2), (4) Date: Nov. 25, 2013

(87) PCT Pub. No.: WO2013/150953
PCT Pub. Date: Oct. 10, 2013

(65) Prior Publication Data

US 2014/0085043 A1 Mar. 27, 2014

(30) Foreign Application Priority Data

Apr. 4, 2012 (JP) ..... 2012-085966

(51) Int. Cl.

| | |
|---|---|
| ***H01C 7/10*** | (2006.01) |
| ***H01C 7/12*** | (2006.01) |
| ***H01C 1/14*** | (2006.01) |
| ***H01C 7/102*** | (2006.01) |
| *H01C 1/022* | (2006.01) |
| *H01C 7/112* | (2006.01) |

(52) U.S. Cl.
CPC .. *H01C 7/12* (2013.01); *H01C 1/14* (2013.01); *H01C 7/1006* (2013.01); *H01C 7/102* (2013.01); *H01C 1/022* (2013.01); *H01C 7/112* (2013.01)
USPC ..... 338/21; 338/210

(58) Field of Classification Search
CPC ..... H01C 7/10; H01C 7/12
USPC ..... 338/21, 210
See application file for complete search history.

(56) References Cited

U.S. PATENT DOCUMENTS

| | | | |
|---|---|---|---|
| 3,210,831 | A | 10/1965 | Johnson et al. |
| 3,648,002 | A | 3/1972 | Du Rocher |

(Continued)

FOREIGN PATENT DOCUMENTS

| | | |
|---|---|---|
| EP | 2 618 342 | 7/2013 |
| JP | S60-211801 | 10/1985 |

(Continued)

OTHER PUBLICATIONS

Extended European Search Report dated Sep. 18, 2014, Application No. 13772928.1.

*Primary Examiner* — Kyung Lee
(74) *Attorney, Agent, or Firm* — Rankin, Hill & Clark LLP

(57) ABSTRACT

Provided is a non-linear resistive element which enables to narrow an interval between a plurality of electrodes. A ceramic sheet (2) which constitutes the non-linear resistive element is configured by being supported in a sheet like form by a support member (22) composed of an insulating material. A plurality of ceramic pieces (21) are sectioned and arranged in each of a plurality of unit areas (23) which are apart from each other.

3 Claims, 8 Drawing Sheets

(56) References Cited

U.S. PATENT DOCUMENTS

| | | | | |
|---|---|---|---|---|
| 3,727,165 | A | 4/1973 | Hagen | |
| 5,262,754 | A * | 11/1993 | Collins | 338/21 |
| 6,055,147 | A * | 4/2000 | Jeffries et al. | 361/103 |
| 6,711,807 | B2 * | 3/2004 | Duggal et al. | 29/614 |
| 6,794,980 | B2 * | 9/2004 | Chu et al. | 338/22 R |
| 2009/0009921 | A1 | 1/2009 | Wosgien | |
| 2009/0179731 | A1 * | 7/2009 | Ihle et al. | 338/212 |

FOREIGN PATENT DOCUMENTS

| | | |
|---|---|---|
| JP | 02-062005 | 3/1990 |
| JP | 2004-006519 | 1/2004 |
| JP | 2008-218749 | 9/2008 |
| WO | 2012/046765 | 4/2012 |

* cited by examiner

NON-LINEAR RESISTIVE ELEMENT

TECHNICAL FIELD

The present invention relates to a non-linear resistive element which is used for an electric equipment built in with, for example, a surge arrester, a surge absorber element or a voltage stabilizing element or the like, and which protects the electric equipment from abnormal voltage such as lightning surge or switching surge.

BACKGROUND ART

Non-linear resistive elements generally called a varistor show a characteristic of a resistance value thereof varying with a voltage applied thereto, i.e., have a non-linear voltage-current characteristic such that the element has a high resistance value showing an insulating characteristic when a normal voltage is applied thereto, while having a low resistance value when an abnormal high voltage is applied thereto. The varistor having such characteristic are broadly utilized in a surge arrester or a surge absorber for the purpose of absorbing surge and noise, or in a voltage stabilizing element.

The non-linear resistive element is, for example, composed of ceramic sintered compact (green body) obtained by molding and sintering zinc oxide powder including a bismuth oxide, antimony oxide, and cobalt oxide as basic additive to develop a non-linear voltage-current characteristic, and various types of oxide added to further increase the performance, which are added to zinc oxide as a primary component, and by sintering the compact.

On a surface and a reverse surface of this ceramic sintered compact, a base conductive layer is formed by a glazing process of silver paste. On this base conductive layer, metal electrode plates composed of a conductor of copper, brass, or aluminum or the like, are plurally joined by soldering. Then, a main portion including the ceramic sintered compact and the electrode plate is molded by epoxy resin or the like, thereby a non-linear resistive element in which a terminal area of an electrode member is derived from the mold part is made into a product. (for example, Patent Document 1).

PRIOR ART DOCUMENTS

Patent Documents

Patent Document 1: Japanese Patent Application Laid-Open No. 2004-6519

SUMMARY OF THE INVENTION

Problem to be Solved by the Invention

However, a metal electrode plate composed of a conductor has a larger thermal expansion rate compared to a ceramic sintered compact which is integrally sintered. Therefore, there is a fear that cracks are formed in the ceramic sintered compact and damaging the same due to thermal stress during soldering of the electrode plate or while using the varistor in the conventional non-linear resistive elements. Moreover, since a ceramic sintered compact formed in a sheet-like shape is weak with respect to external force, there is a fear that it is also damaged by the external force which occurs during transportation or mounting. In order to avoid such problems, in the conventional non-linear resistive elements, a countermeasure was taken to form the plate thickness of the ceramic sintered compact to be thick so as to enhance rigidness.

On the other hand, a plurality of the electrode plates joined on the ceramic sintered compact need to have an interval between the electrode plates not less than two times the plate thickness of the ceramic sintered compact in order to prevent short circuit between the electrode plates. However, in the conventional non-linear resistive elements, since it is necessary to form the plate thickness of the ceramic sintered compact to be thick, the interval between electrode plates becomes large. As a result, the whole non-linear resistive element becomes enlarged. As such, there is a problem that it becomes difficult to mount the enlarged non-linear resistive element to a small space on the wiring substrate.

Therefore, in view of the above problem, it is an object of the present invention to provide a non-linear resistive element capable of narrowing the interval between a plurality of electrodes and to achieve downsizing of the whole configuration of the non-linear resistive element.

Means for Solving the Problem

A non-linear resistive element of the present invention comprises at least a ceramic sheet configured by a plurality of ceramic pieces composed of ceramic sintered compact and a sheet-like support member composed of insulating material supporting each of the plurality of the ceramic pieces, one or the plurality of the ceramic pieces configure each of a plurality of conductive paths which penetrate the ceramic sheet in a thickness direction thereof, and the ceramic pieces configuring both ends of the conductive paths are partially exposed from the support member, wherein each of the plurality of the ceramic pieces is supported by the support member in a state in which the plurality of the ceramic pieces are sectioned and arranged in each of a plurality of unit areas which are apart from each other.

According to the non-linear resistive element of the present invention, both ends of the conductive path formed by the plurality of ceramic pieces expose from the support member and the plurality of the ceramic pieces are sectioned and arranged in each unit area which are separate from each other. That is, among the insulating support member, by the portion configuring a boundary region or an intermediate region between different unit areas, the one or the plurality of the ceramic pieces arranged in each of the different unit areas are insulated.

Therefore, according to an arrangement pattern of the plurality of the unit areas, even in a case where a plurality of conductors or electrodes are arranged so as to have electrical contact with the ceramic pieces arranged in each unit area, it is able to prevent short circuit of the plurality of the conductors or electrodes. In addition to this, compared to the prior art in which the ceramic sheet is configured by ceramic sintered compact of bulk, the interval between the plurality of the conductors or the electrodes are narrowed. Therefore, the interval between the plurality of the unit areas are narrowed to this extent, and downsizing of the ceramic sheet, thus the non-linear resistive element (a varistor, or a varistor also used as a capacitor or the like) having the ceramic sheet and the plurality of conductors or electrodes as its components, is attained.

According to the non-linear resistive element of the present invention, it is preferable that the non-linear resistive element comprises a plurality of electrode plates arranged on one or both of a pair of main faces of the ceramic sheet, in a state electrically conducted with a single or a plurality of the ceramic pieces arranged in each of the plurality of the unit areas, and apart from each other across a boundary region between different unit areas among the support member.

According to the non-linear resistive element of the above configuration, the plurality of the unit areas are sectioned by insulating boundary regions so that each of the unit areas can be used as independent non-linear resistive element (a varistor, or a varistor also used as a capacitor or the like). Therefore, in a case where the size or the shape or the like of the electrode plate is changed, it is able to obtain a non-linear resistive element having a different electric characteristic before and after the change of the electrode plate. For example, if it is changed to an electrode plate with a large surface area, a surface area of the unit area which contacts the electrode plate increases, and a non-linear resistive element with a large energy withstand capacity can be obtained.

By this, the downsizing of the total configuration of the non-linear resistive element can be attained, while easily enabling to change the electric characteristic of the non-linear resistive element by changing the electrode plate.

Moreover, it is preferable that the non-linear resistive element of the present invention is a non-linear resistive element in which the electrode plates are arranged on each of the pair of main faces of the ceramic sheet, comprising, a pair of insulating retainer plates arranged on each face of the electrode plates at an opposite side of a face of the electrode plates contacting the ceramic sheet, and a switching element which is electrically conducted with the ceramic pieces arranged in the plurality of the unit areas to which each of the plurality of the electrode plates corresponds, and which switches between a sandwiched state in which the ceramic sheet and the pair of the electrode plates contacting each of the pair of the main faces thereof are sandwiched between the retainer plates, and a detached state in which the ceramic sheet and the pair of the electrode plates contacting each of the pair of the main faces thereof are detached from the retainer plates.

According to the non-linear resistive element having the above configuration, it is equipped with a switching element (a fastening screw or a clip or the like) capable of switching between a sandwiched state in which the ceramic sheet and the pair of the electrode plates contacting each of the pair of the main faces thereof are sandwiched and retained between the pair of retainer plates, and a detached state in which the ceramic sheet and the pair of the electrode plates contacting each of the pair of the main faces thereof are detached from the retainer plates. That is, since the ceramic sheet and the electrode plates are not joined by soldering as the conventional non-linear resistive elements, it is able to separate and take out the ceramic sheet and the electrode plate.

Therefore, for example, in a case the performance of the ceramic sheet degrades, it is able to easily exchange the ceramic sheet. Moreover, in a case it is desirable to change the electric characteristic of the non-linear resistive element, it is able to easily exchange the electrode plates. By this, the improvement of maintainability of the non-linear resistive element can be attained.

MODE FOR CARRYING OUT THE INVENTION

First Embodiment of the Present Invention

Figure 1:
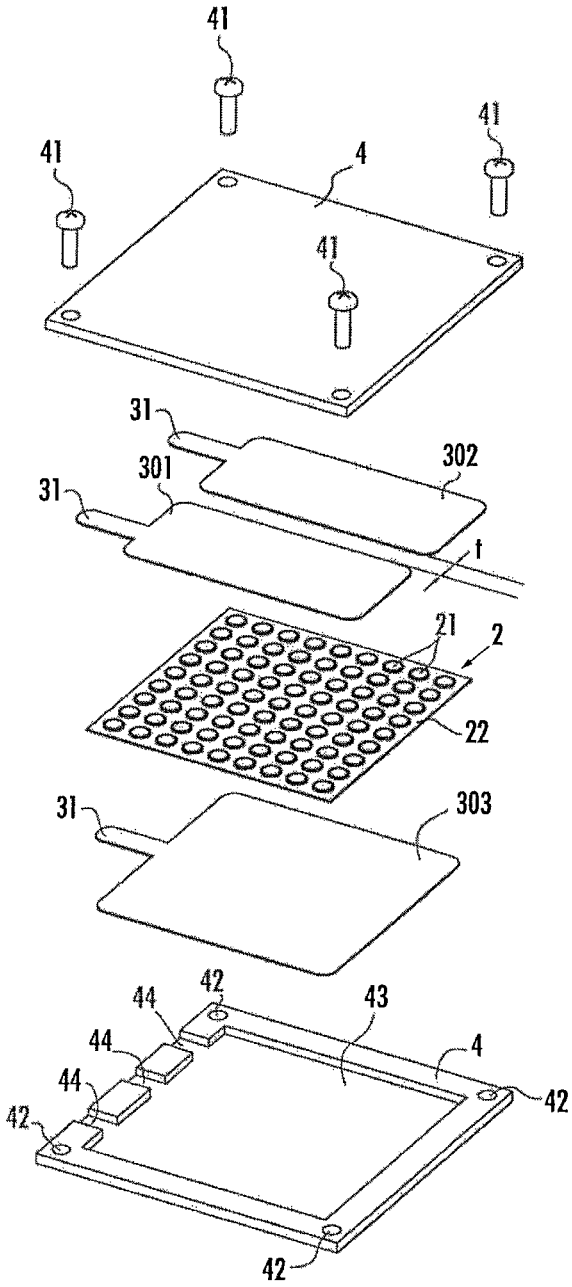
FIG. 1 is an explanatory view showing a non-linear resistive element of a first embodiment of the present invention.

A first embodiment of a non-linear resistive element of the present invention is explained with reference to FIG. 1 and FIG. 2.

The non-linear resistive element 1 in the first embodiment of the present invention is configured of a sheet-like formed ceramic sheet 2, a plurality of electrode plates 301 to 303 arranged on each of a pair of main faces of the ceramic sheet 2 in a state separable, and a pair of insulating retainer plates 4 each arranged on a face of the electrode plates 301 to 303 on the opposite side of a face contacting the ceramic sheet 2.

The ceramic sheet 2 is configured of a plurality of ceramic pieces (or ceramic beads) 21 composed of ceramic sintered compact having zinc oxide (ZnO) as its main component, and a support member 22 composed of insulating material which supports each of these ceramic pieces 21 in a state spaced from each other. These ceramic pieces 21 have a face which exposes from a surface of the insulating support member 22 and a face which exposes from a rear surface of the support member 22. Furthermore, these ceramic pieces are supported by the support member 22 in a state spaced from each other and arranged. Therefore, each of these individual ceramic pieces 21 forms a plurality of unit areas 23 which are capable of being used as an independent non-linear resistive element (a varistor or a varistor also used as a capacitor or the like).

Here, in the first embodiment, the ceramic pieces 21 are supported in a state each ceramic piece is spaced from each other in a direction parallel to the main face of the ceramic sheet 2. However, within the same unit area 23, they may be in contact with each other. Moreover, the ceramic pieces 21 are not limited to a circular shape and may be a rectangular shape or other square shape such as a polygonal shape or the like, ellipse shape, spherical shape, or oval sphere shape, or the like.

Moreover, the ceramic sheet 2 is manufactured by the manner shown below. First, $Bi_2O_3$: 0.5 mol %, $Sb_2O_3$: 1.0 mol %, $Co_2O_3$: 0.5 mol %, $MnO_2$: 0.5 mol %, $Cr_2O_3$: 0.5 mol % and $Al(NO_3).9H_2O$: 0.01 mol % are added to ZnO as a primary component. Then, solvent and dispersant are added and mixed, and thereafter a binder is added to prepare a slurry, and formed in a powder by a spray drier. The powder is molded in a die and a compact having a diameter of 4.3 mm and thickness of 1.2 mm is obtained. The compact is sintered at 1100° C. for 2 hours to form a circular ceramic piece 21 with a thickness of 1 mm and a diameter of 3.6 mm. Moreover, the ceramic piece 21 is thermally treated if necessary.

The plurality of ceramic pieces 21 obtained as mentioned above are arranged, for example, apart from each other on the same plane in the mold, and by injection molding method or insert molding method which injects insulating resin into the space between the plurality of ceramic pieces 21, the ceramic sheet 2 is manufactured.

Furthermore, in the above, although it is explained that the ceramic sheet 2 is manufactured by injection molding method or insert molding method, the manufacturing method of the ceramic sheet 2 is not limited thereto. For example, the ceramic sheet 2 may be manufactured by a method of kneading the ceramic pieces 21 and the insulating resin in a state having flowability and then extruding (doctor blade method or extrusion molding method), or by a method of filling the ceramic pieces 21 and resin which hardens by heat or ultraviolet ray in the mold and consolidating the resin.

Moreover, the material composition of the ceramic pieces 21 is not limited to a non-linear resistive element 1 of a $Bi_2O_3$ system in which $Bi_2O_3$ is added to zinc oxide as the main component, but can be a non-linear resistive element 1 of $Pr_6O_{11}$ system, $BaTiO_3$ system, $SrTiO_3$ system, $TiO_2$ system, $SnO_2$ system, or $Fe_3O_4$ system. Furthermore, in the above embodiment, although it is explained that the ceramic pieces 21 are composed of compact having zinc oxide as the main component, it may be any ceramics having a non-linear electric resistive characteristic such as strontium titanate, silicon carbide, tin oxide, or the like.

Furthermore, by using resin material having superior fire retardancy, thermal resistance or thermal conductivity as the support member 22 which adheres the ceramic pieces 21, it is able to enhance thermal characteristics and improve electric performance In addition to the selection of this resin material itself, it is also effective to add various additive substances for improving fire retardancy, thermal resistance, or thermal conductivity. For example, oxides or non-oxides of alumina, aluminum nitride, or boron nitride, particles of thermal conductive particles whose surfaces are insulation processed (which may be either metal or non-metal compound), and in some cases, a small amount of conductive particles within a range that the insulating property does not degrade may be added.

The electrode plates 301 to 303 are formed of a metal flat plate material composed of conductors such as copper, brass, or aluminum or the like, and a terminal area 31 for electrically connecting with a wiring substrate or the like is provided extending integrally from a main body portion of the electrode plates 301 to 303. By using this terminal area 31, for example, it becomes easy to implement the non-linear resistive element to the wiring substrate or the like.

Figure 2A:
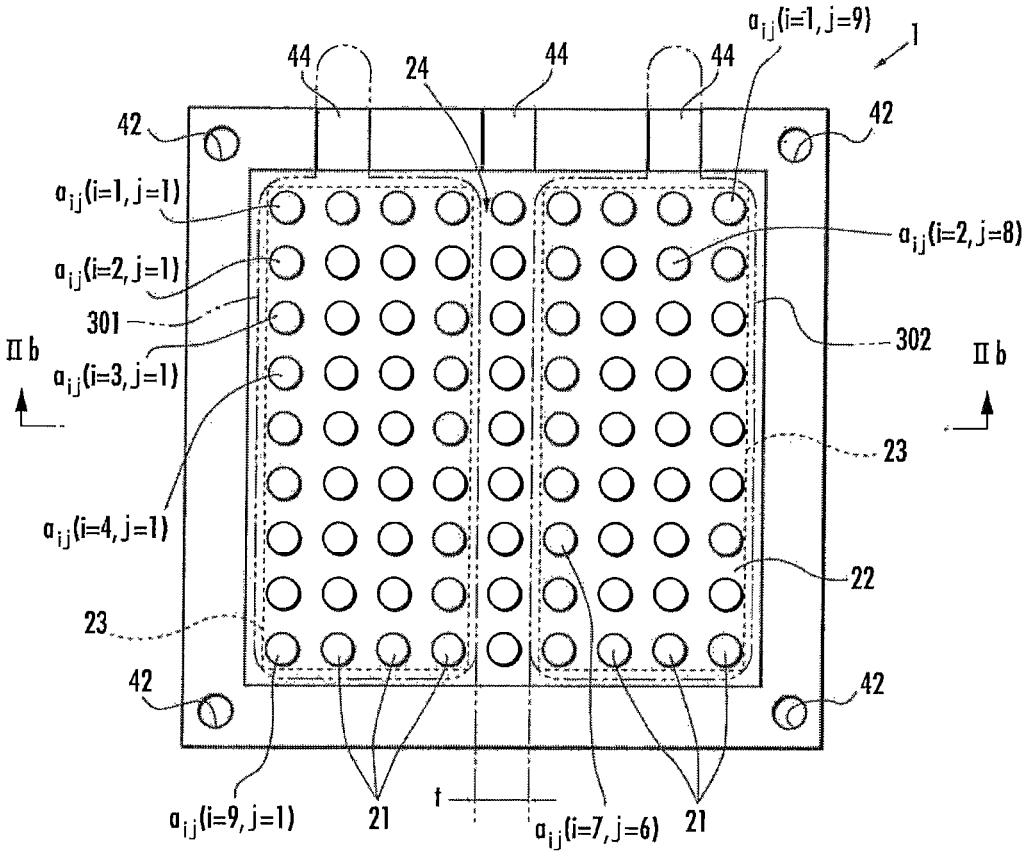
FIG. 2A and FIG. 2B are explanatory views showing a state in which electrode plates are arranged according to an arrangement pattern of unit areas in the first embodiment of the present invention.
Figure 2B:
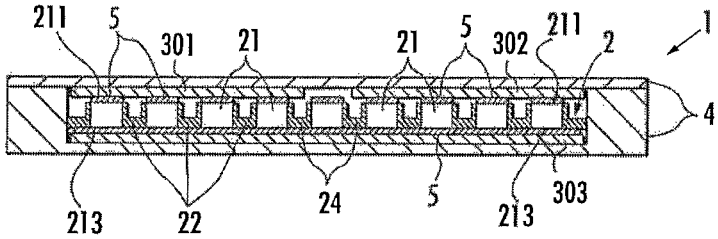

In FIG. 2, the area surrounded by a two-dot chain line indicates the electrode plates 301 to 303 arranged on the main face on the upper side of the ceramic sheet 2. Furthermore, the area surrounded by a dashed line in FIG. 2 indicates the unit area 23 which is defined differently according to each embodiment. Here, only the arrangement manner of the unit area 23 on the main face on the upper side of the ceramic sheet 2 of FIG. 1, is shown.

It is considered that each of the ceramic pieces 21 arranged in 9 rows and 9 columns is distinguished by element $\{a_{ij}$ $(i=1\sim9, j=1\sim9)\}$ of the square matrix of size 9.

According to the embodiment shown in FIG. 2, two electrode plates 301 and 302 are arranged on the main face of the upper side of the ceramic sheet 2, and one electrode plate 303 is arranged on the main face of the lower side. The combination of ceramic pieces 21 which each of the two electrodes 301 and 302 on the upper side contacts is expressed by two groups $(a_{ij}(i=1\sim9, j=1\sim4))$ and $(a_{ij}(i=1\sim9, j=6\sim9))$, respectively.

That is, in this case, on the main face of the upper side of the ceramic sheet 2, two unit areas 23 including the two groups of ceramic pieces 21 are defined (refer to the dashed line of FIG. 2). On the other hand, the electrode plate 303 on the lower side is entirely the group of ceramic pieces 21 $(a_{ij}(i=1\sim9, j=1\sim9))$.

A non-linear resistive element 1 configuring a sequence of electric conductive path, such as electrode plate 301→group of ceramic pieces 21 $(a_{ij}(i=1\sim9, j=1\sim4))$→electrode plate 303→group of ceramic pieces 21 $(a_{ij}(i=1\sim9, j=6\sim9))$→electrode plate 302, is obtained.

Moreover, electrode plates 301 and 302 are prevented from short circuit by an insulating material existing in the boundary region 24 in which group of ceramic pieces 21 $(a_{ij}(i=1\sim9, j=5))$ is included, and which is arranged between the unit areas 23 corresponding to the electrode plates 301 and 302. By this, the narrowing of interval t between electrode plates 301 and 302 arranged on the main face of the upper side of the ceramic sheet 2 is attained.

The ceramic pieces 21 of the ceramic sheet 2 and the electrode plates 301 to 303 may be conducted through the intermediary of a conductive resin 5. By this, it is able to ensure to make conduction of the ceramic pieces 21 and the electrode plates 301 to 303 even if some gap is generated on the surface and rear surface of each ceramic sheet 2 at the time of manufacturing.

The conductive resin 5 is formed by applying conductive paste including silver particles and thermoplastic resin on ceramic pieces 21 or one or both faces of the ceramic sheet 2, and then drying. As the material composition of the conductive resin 5, it is able to use room temperature curing type conductive adhesive including silver as conductive particles or otherwise thermal curing-type conductive adhesive. Moreover, copper, gold, or carbon or the like may be used as the conductive particle other than silver.

Retainer plates 4 are formed in a flat plate shape having a surface area larger than the ceramic sheet 2 and the electrode plates 301 to 303. Moreover, a male screw part (switching element) is provided at the four corners of the retainer plates 4 for switching between a sandwiched state in which the ceramic sheet 2 and the electrode plates 301 to 303 are sandwiched and retained between the retainer plates and a detached state in which the ceramic sheet and the electrode plates detach from the retainer plates. This male screw part 41 screws with female screw part 42 formed on one of the retainer plates 4. That is, by fastening the male screw part 41, the ceramic sheet 2 and the electrode plates 301 to 303 are fixed in a state sandwiched between the retainer plates 4. And by loosening the male screw part 41, the ceramic sheet 2 and the electrode plates 301 to 303 are detached from the retainer plates 4, respectively.

According to the above, even in a case of desiring to change the electric characteristic of the non-linear resistive element 1, or in a case the performance of the ceramic sheet 2 has degraded, since the ceramic sheet 2 or the electrode plates 301 to 303 of the non-linear resistive element main body can be easily exchanged, the improvement of maintainability of the non-linear resistive element is attained.

For example, there are cases where change of electric characteristics such as varistor voltage and energy withstand capacity or the like is required according to the specification and use of the surge arrester or the surge absorber. In such cases, in the conventional non-linear resistive elements in which the electrode plate and the ceramic sintered compact (ceramic sheet) are soldered, measures may be taken to adjust the varistor voltage or energy withstand capacity or the like by preparing a plurality of non-linear resistive elements and connecting them in series or parallel. However, such measures needed to secure space for mounting the new plurality of non-linear resistive elements and in some cases required design modification of the wiring substrate, which made it difficult to change the electric characteristic of the non-linear resistive element.

On the other hand, according to the non-linear resistive element 1 of the first embodiment of the present invention, since the ceramic sheet 2 and the electrode plates 301 to 303 are not joined by soldering or the like as the conventional non-linear resistive elements, it is able to separate and exchange the ceramic sheet 2 and the electrode plates 301 to 303. Therefore, it is able to easily change the electric characteristic of the non-linear resistive element 1.

By changing at least one of each area, shape, and arrangement manner of each electrode plate 301 to 303 and each unit area 23 which includes the ceramic pieces 21 contacting the each electrode plate 301 to 303, a non-linear resistive element 1 having a plurality of different electric characteristics can be configured by a single ceramic sheet 2 having a plurality of ceramic pieces 21 as its element.

Figure 3A:
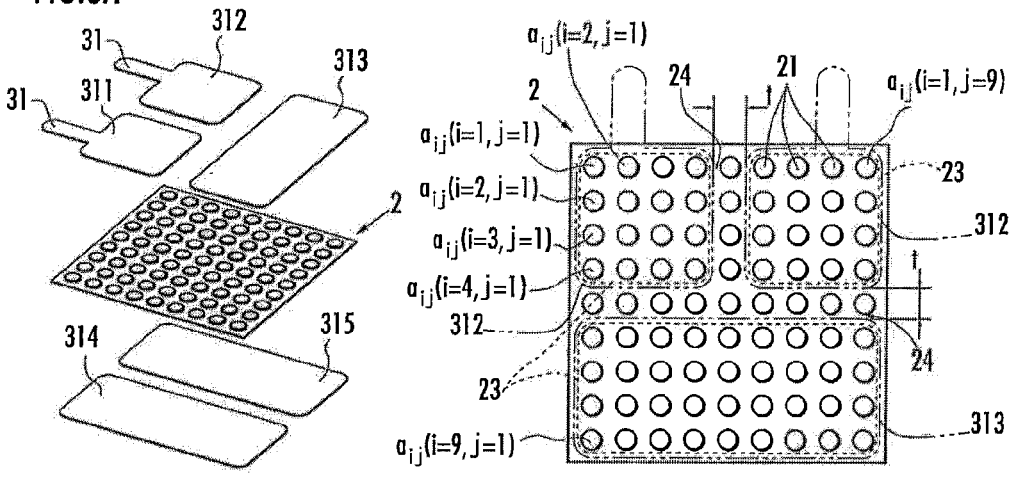
FIG. 3A, FIG. 3B, FIG. 3C are explanatory views which exemplifies electrode plates for replacement.
Figure 3B:
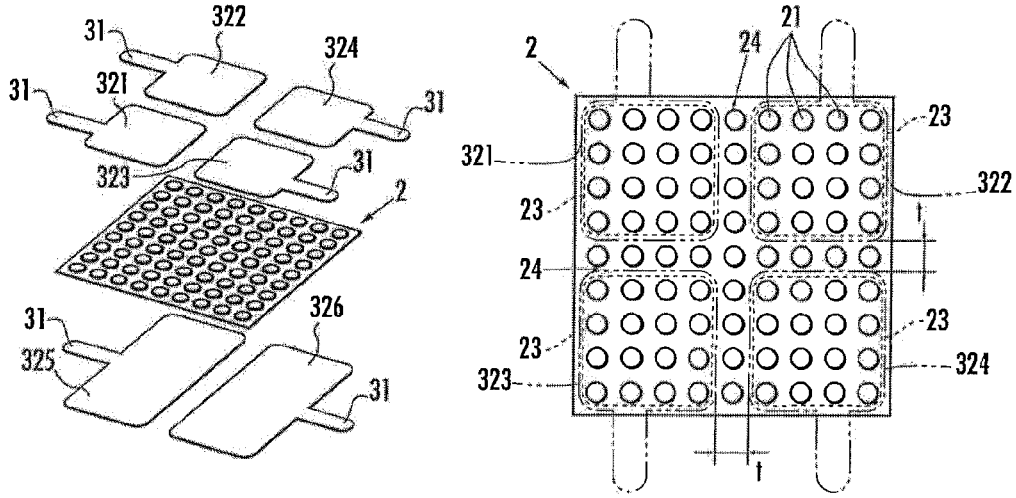
Figure 3C:
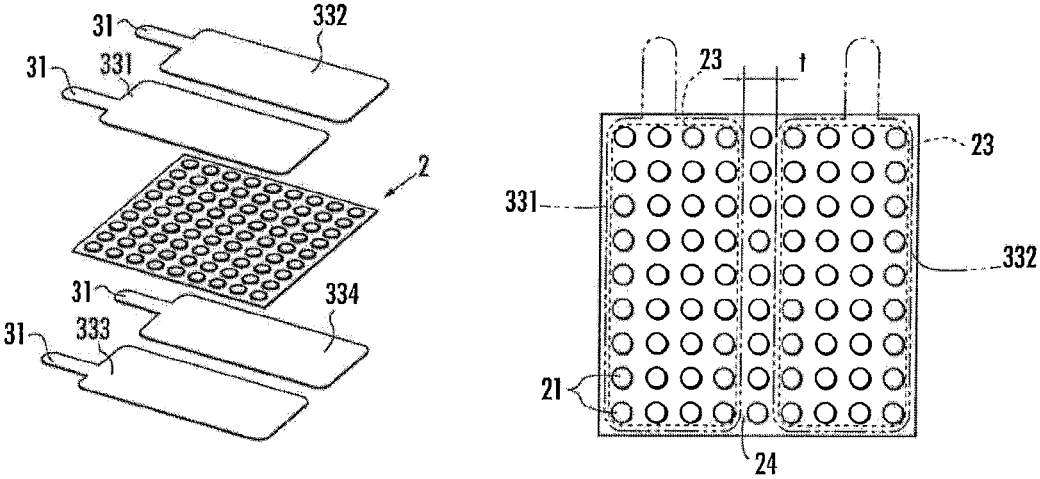

An embodiment of a configuration of the non-linear resistive element 1 with different electric characteristics is explained in reference to FIG. 3. On the right side of each of FIG. 3A to FIG. 3C, the region surrounded by a dashed line indicates unit areas 23 defined differently for each embodiment. Here, only the arrangement manners of the unit area 23 on the main face of the upper side of the ceramic sheet 2 indicated in the left side of each of FIG. 3A to FIG. 3C, are shown. Furthermore, the region surrounded by the two-dot chain line on the right side of each of FIG. 3A to FIG. 3C indicates electrode plates 311 to 313, 321 to 324, and 331 to 332 arranged on the main face of the upper side of the ceramic sheet 2.

Each of the ceramic pieces 21 arranged in 9 rows and 9 columns is considered to be distinguished by an element $\{a_{ij}(i=1\sim9, j=1\sim9)\}$ of the square matrix of size 9.

According to the embodiment shown in the left side of FIG. 3A, three electrode plates 311 to 313 are arranged on the main face of the upper side of the ceramic sheet 2, and two electrode plates 314 and 315 are arranged on the main face of the lower side. The combination of ceramic pieces 21 which each of the three electrode plates 311 to 313 on the upper side contacts, is expressed by each of the three groups ($a_{ij}(i=1\sim4, j=1\sim4)$), ($a_{ij}(i=1\sim4, j=6\sim9)$), and ($a_{ij}(i=6\sim9, j=1\sim9)$). The combination of ceramic pieces 21 which each of the two electrode plates 314 and 315 of the lower side contacts, is the two groups ($a_{ij}(i=1\sim9, j=1\sim4)$) and ($a_{ij}(i=1\sim9, j=6\sim9)$), respectively.

That is, in such case, on the main face of the upper side of the ceramic sheet 2, three unit areas 23 encompassing the three groups of ceramic pieces 21 are defined (refer to FIG. 3A dashed line). On the other hand, on the main face of the lower side of the ceramic sheet 2, two unit areas 23 encompassing each of the two groups of ceramic pieces 21 are defined.

A non-linear resistive element 1 with a large varistor voltage configuring a sequence of electric conductive path, such as electrode plate 311→group of ceramic pieces 21 ($a_{ij}(i=1\sim4, j=1\sim4)$)→electrode plate 314→group of ceramic pieces 21 ($a_{ij}(i=6\sim9, j=1\sim4)$)→electrode plate 313→group of ceramic pieces 21 ($a_{ij}(i=6\sim9, j=6\sim9)$)→electrode plate 315→group of ceramic pieces 21 ($a_{ij}(i=1\sim4, j=6\sim9)$)→electrode plate 312, is obtained.

Moreover, the electrode plates 311 and 312 are prevented from short circuit by the insulating material existing in the boundary region 24 which is arranged between the unit areas 23 corresponding to each of the electrode plates 311 and 312 and which includes group of ceramic pieces 21 ($a_{ij}(i=1\sim4, j=5)$). Similarly, electrode plates 311 and 313, 312 and 313, and 314 and 315 are prevented from short circuit. By this, the narrowing of interval t between the electrode plates is attained similar to the first embodiment.

According to the embodiment shown in the left side of FIG. 3B, four electrode plates 321 to 324 are arranged on the main face of the upper side of the ceramic sheet 2, and two electrode plates 325 and 326 are arranged on the main face of the lower side. The combination of ceramic pieces 21 which each of the four electrode plates 321 to 324 on the upper side contacts, is expressed by each of the four groups ($a_{ij}(i=1\sim4, j=1\sim4)$), ($a_{ij}(i=1\sim4, j=6\sim9)$), ($a_{ij}(i=6\sim9, j=1\sim4)$), and ($a_{ij}(i=6\sim9, j=6\sim9)$). The combination of ceramic pieces 21 which each of the two electrode plates 325 and 326 of the lower side contacts, is the two groups ($a_{ij}(i=1\sim4, j=1\sim9)$) and ($a_{ij}(i=6\sim9, j=1\sim9)$), respectively.

That is, in such case, on the main face of the upper side of the ceramic sheet 2, four unit areas 23 encompassing the four groups of ceramic pieces 21 are defined (refer to FIG. 3B dashed line). On the other hand, on the main face of the lower side of the ceramic sheet 2, two unit areas 23 encompassing each of the two groups of ceramic pieces 21 are defined.

The non-linear resistive element 1 is configured as two separate non-linear resistive elements. That is, two non-linear resistive elements configured by each of a sequence of electric conductive path, such as electrode plate 321→group of ceramic pieces 21 ($a_{ij}(i=1\sim4, j=1\sim4)$)→electrode plate 325→group of ceramic pieces 21 ($a_{ij}(i=6\sim9, j=1\sim4)$)→electrode plate 322, and a sequence of electric conductive path, such as electrode plate 323→group of ceramic pieces 21 ($a_{ij}(i=6\sim9, j=1\sim4)$)→electrode plate 326→group of ceramic pieces 21 ($a_{ij}(i=6\sim9, j=6\sim9)$)→electrode plate 324, are configured.

Moreover, the electrode plates 321 and 322 are prevented from short circuit by the insulating material existing in the boundary region 24 which is arranged between the unit areas 23 corresponding to each of the electrode plates 321 and 322, and which includes group of ceramic pieces 21 ($a_{ij}(i=1\sim4, j=5)$). Similarly, electrode plates 321 and 323, 322 and 324, 323 and 324, and 325 and 326 are prevented from short circuit. By this, the narrowing of interval t between the electrode plates is attained similar to the first embodiment.

According to the embodiment shown in the left side of FIG. 3C, two electrode plates 331 and 332 are arranged on the main face of the upper side of the ceramic sheet 2, and two electrode plates 333 and 334 are arranged on the main face of the lower side. The combination of ceramic pieces 21 which each of the two electrode plates 331 and 332 on the upper side contacts, is expressed by each of the two groups ($a_{ij}(i=1\sim9, j=1\sim4)$) and ($a_{ij}(i=1\sim9, j=6\sim9)$). The combination of ceramic pieces 21 which each of the two electrode plates 333 and 334 of the lower side contacts, is the two groups ($a_{ij}(i=1\sim9, j=1\sim4)$) and ($a_{ij}(i=1\sim9, j=6\sim9)$), respectively.

That is, in such case, on the main face of the upper side of the ceramic sheet 2, two unit areas 23 encompassing the two groups of ceramic pieces 21 are defined (refer to FIG. 3C dashed line). On the other hand, on the main face of the lower side of the ceramic sheet 2, two unit areas 23 encompassing each of the two groups of ceramic pieces 21 are defined.

The non-linear resistive element 1 is configured as two separate non-linear resistive elements. That is, two non-linear resistive elements configured by each of a sequence of electric conductive path, such as electrode plate 331→group of ceramic pieces 21 ($a_{ij}$(i=1~9, j=1~4))→electrode plate 333, and a sequence of electric conductive path, such as electrode plate 332→group of ceramic pieces 21 ($a_{ij}$(i=6~9, j=1~4))→electrode plate 334, are configured.

Moreover, the electrode plates 331 and 332 are prevented from short circuit by the insulating material existing in the boundary region 24 which is arranged between the unit areas 23 corresponding to each of the electrode plates 331 and 332, and which includes group of ceramic pieces 21 ($a_{ij}$(i=1~9, j=5)). Similarly, electrode plates 333 and 334 are prevented from short circuit. By this, the narrowing of interval t between the electrode plates is attained similar to the first embodiment.

Moreover, a receiving portion 43 in which the ceramic sheet 2 and the main body part of the electrode plates 301 to 303 are fit into, and guiding grooves 44 which guide the terminal area 31 of the electrode plates 301 to 303 to outside of the retainer plate 4 are formed in the retainer plate 4. By this, the ceramic sheet 2 and the electrode plates 301 to 303 are positioned to a predetermined position when sandwiching the ceramic sheet 2 and the electrode plates 301 to 303 between the retainer plates 4. Therefore, the assembling operation of the non-linear resistive element 1 becomes easy.

Furthermore, it is desirable that the retainer plates 4 are made of transparent member such as acrylic resin or the like. By doing so, it is able to confirm the size and shape or the like of the ceramic sheet 2 and the electrode plates 301 to 303 being used, in an assembled state without dismantling the non-linear resistive element 1.

The switching element which switches between a sandwiched state and a detached state of the ceramic sheet 2 and the electrode plates 301 to 303, is not limited to a male screw part 41 and a female screw part 42. For example, the sandwiched state of the ceramic sheet 2 and the electrode plates 301 to 303 may be fixed by sandwiching both ends of the retainer plates 4 by something like a clip. Moreover, a hook part may be provided to one of the retainer plates and the other retainer plate may be hooked and fixed using the elasticity of the material, like the so-called snap-fit.

Other Embodiment of the Present Invention

Next, the second to the fifth embodiment of the non-linear resistive element related to the present invention are explained in details with reference to FIG. 4 to FIG. 7.

The features which are the same as the features shown in FIG. 1 and FIG. 2 are indicated by the same reference signs and the explanation thereof are abbreviated. A non-linear resistive element 1 of the second to the fifth embodiment differs only in the configuration of the ceramic pieces 21 arranged in the unit area 23 of the first embodiment.

Figure 4A:
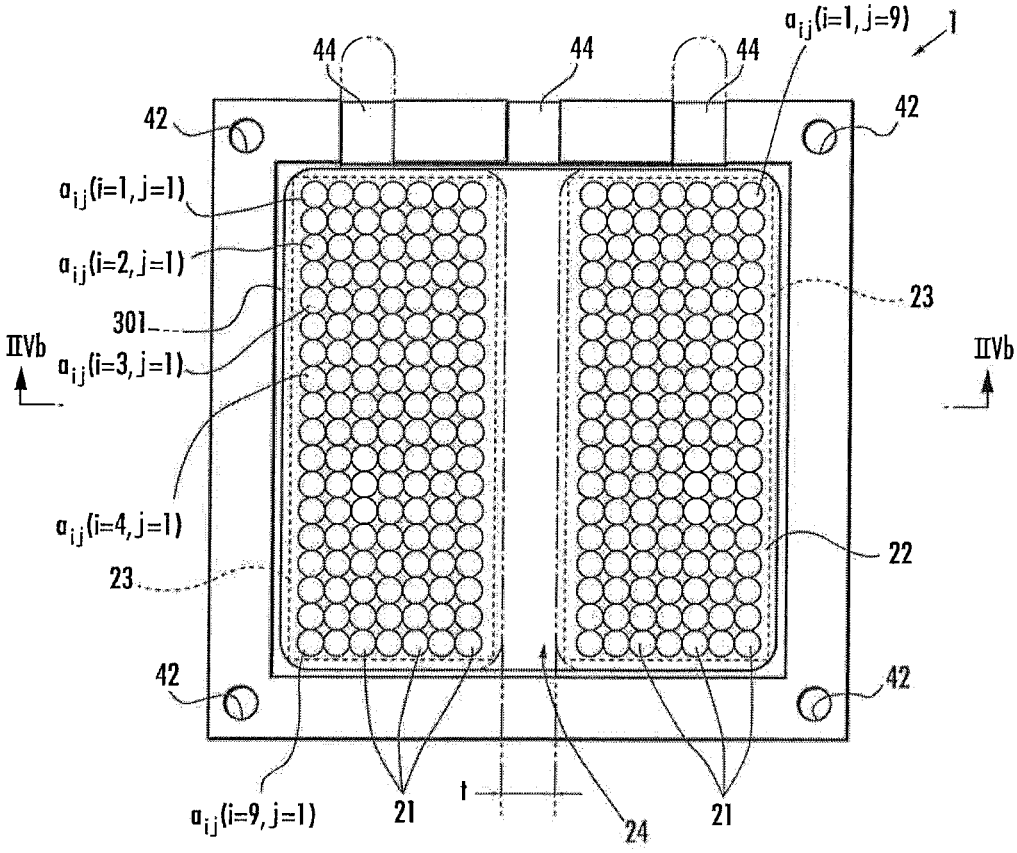
FIG. 4A and FIG. 4B are explanatory views showing a state in which electrode plates are arranged according to an arrangement pattern of unit areas in a second embodiment of the present invention.
Figure 4B:
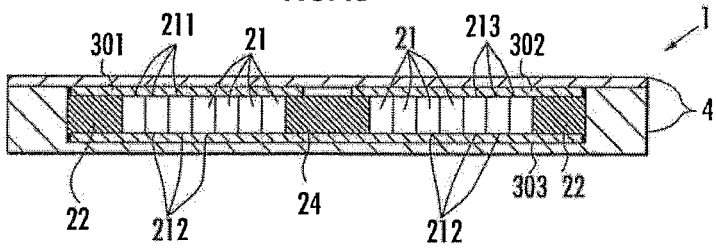

As shown in FIG. 4, ceramic pieces 21 in the second embodiment of the present invention are formed in a columnar shape and have a face 211 exposing from the surface of an insulating support member 22 and a face 212 exposing from a rear surface of the support member 22. Unit area 23 is composed of a plurality of ceramic pieces 21 with respect to one unit area 23, and these ceramic pieces 21 contact each other so as to enable conduction.

Figure 5A:
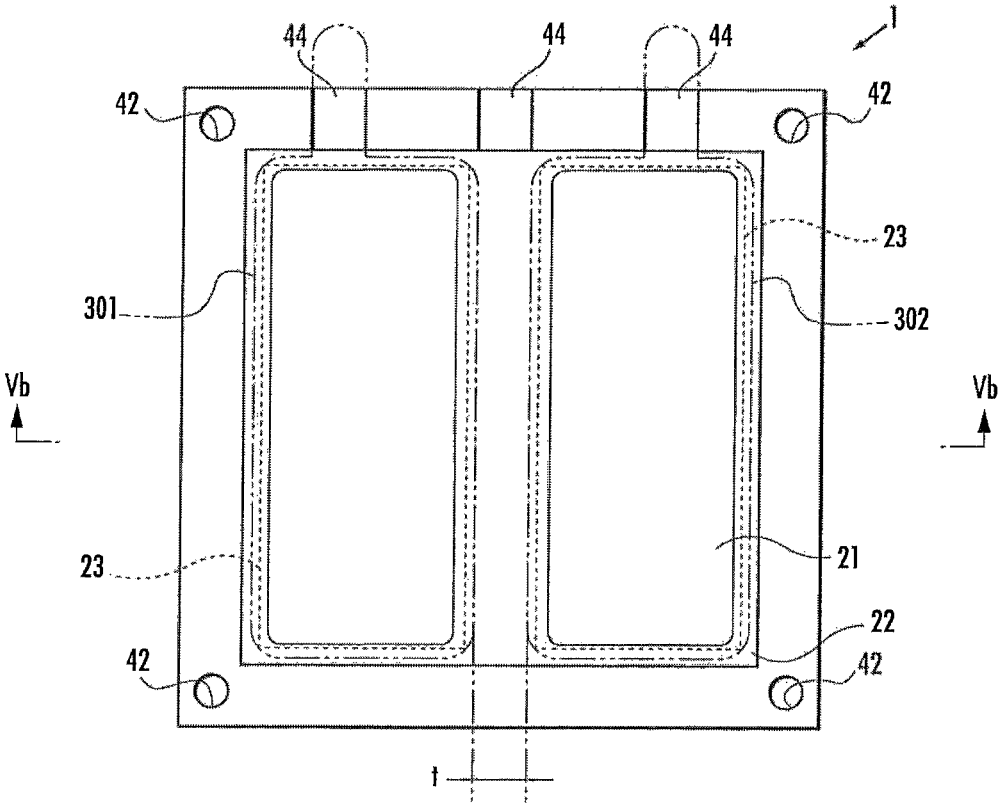
FIG. 5A and FIG. 5B are explanatory views showing a state in which electrode plates are arranged according to an arrangement pattern of unit areas in a third embodiment of the present invention.
Figure 5B:
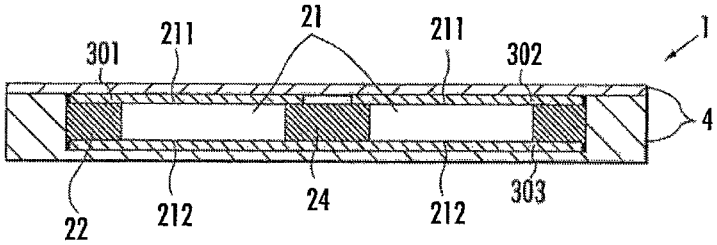

As shown in FIG. 5, ceramic pieces 21 in the third embodiment of the present invention are formed in a flat plate shape and have a face 211 exposing from the surface of an insulating support member 22, and a face 212 exposing from a rear surface of the support member 22. Unit area 23 is composed of one ceramic piece 21 with respect to one unit area 23, and there are only two places as the unit area 23.

Figure 6A:
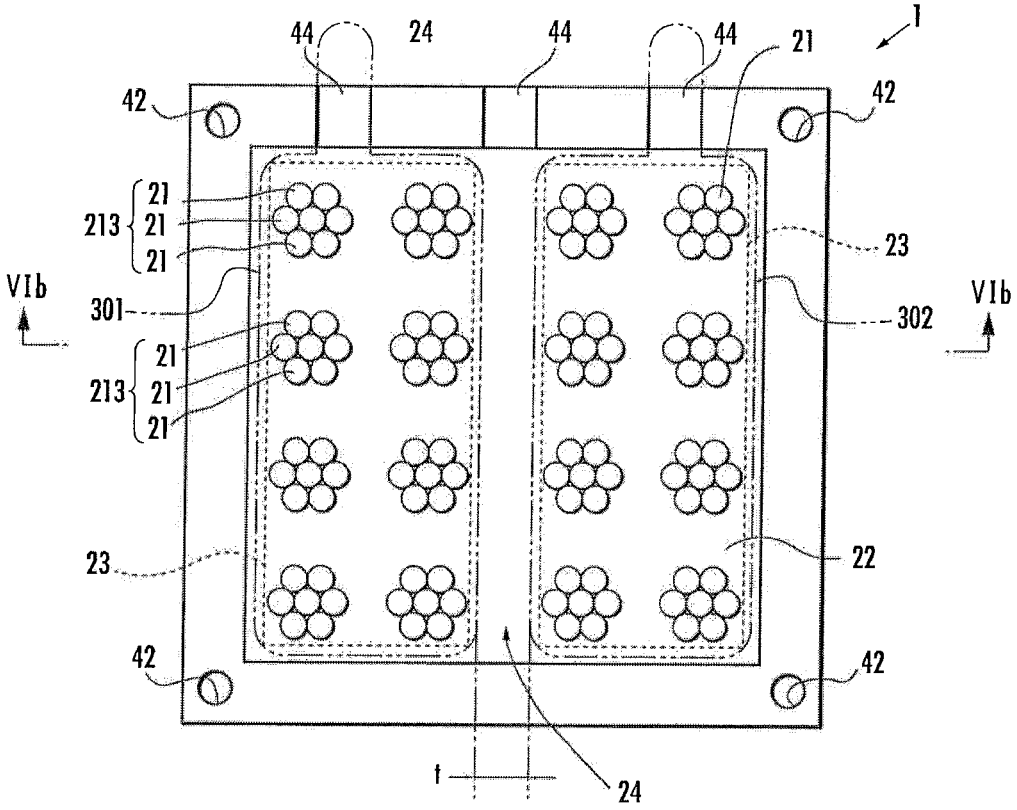
FIG. 6A and FIG. 6B are explanatory views showing a state in which electrode plates are arranged according to an arrangement pattern of unit areas in a fourth embodiment of the present invention.
Figure 6B:
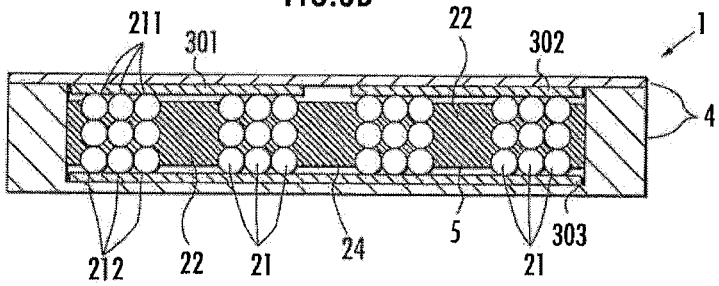

As shown in FIG. 6, ceramic pieces 21 in the fourth embodiment of the present invention are formed in a spherical shape and configure a plurality of ceramic pieces groups 213 in which each of the ceramic pieces contact each other in the horizontal direction and the thickness direction of a ceramic sheet 2. These ceramic piece groups 213 configure respectively a plurality of conductive paths which penetrate in the thickness direction of the ceramic sheet. These conductive paths have a face 211 partially protruding from the surface of a support member 22 and a face 212 partially protruding from a rear surface of the support member 22. Unit area 23 is composed of a plurality of ceramic pieces groups 213 with respect to one unit area 23, and arranged on the same plane of the ceramic sheet 2 and apart from each other via the insulating support member 22.

Figure 7A:
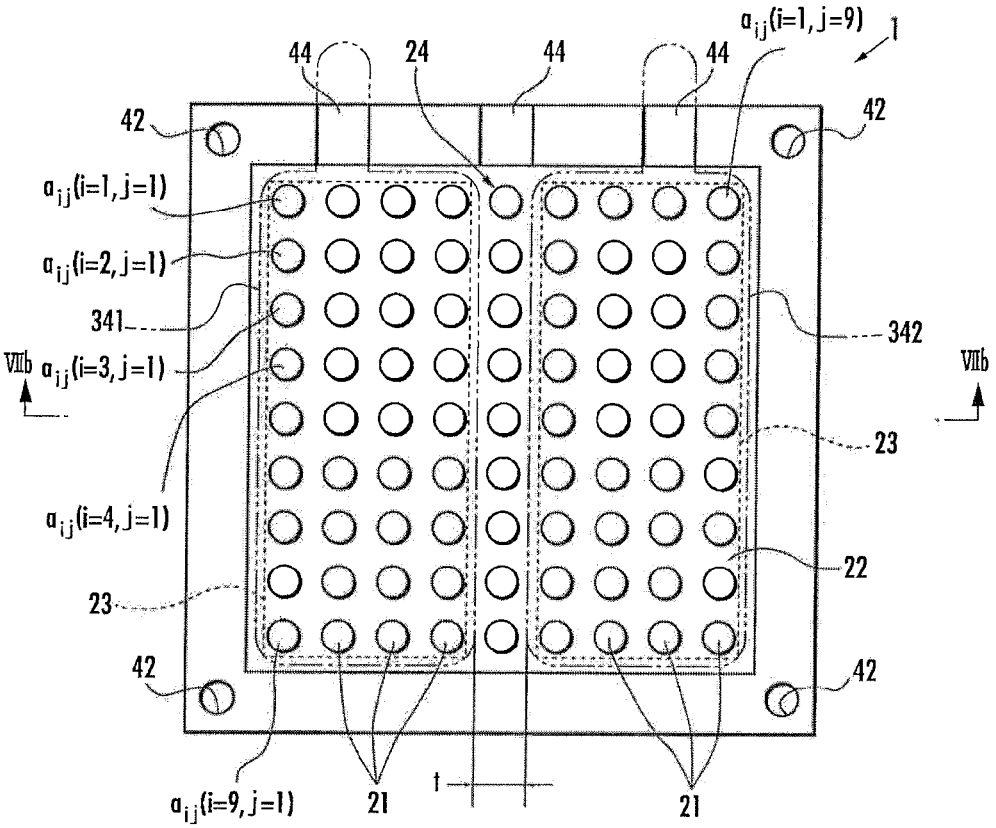
FIG. 7A and FIG. 7B are explanatory views showing a state in which electrode plates are arranged according to an arrangement pattern of unit areas in a fifth embodiment of the present invention.
Figure 7B:
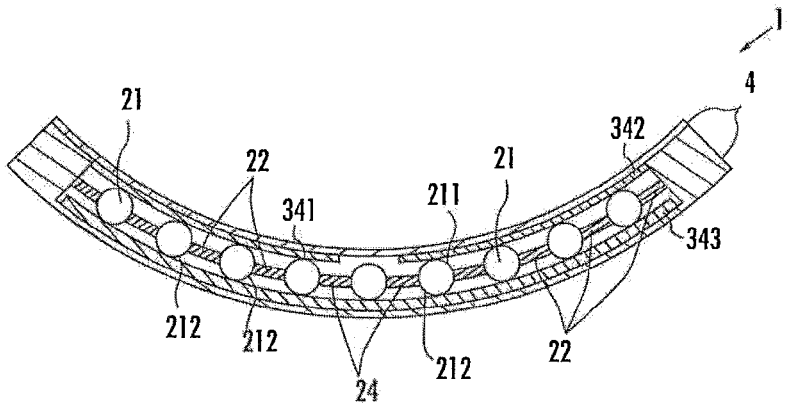

As shown in FIG. 7, ceramic pieces 21 of the fifth embodiment are formed in a spherical shape and have a face 211 protruding from a surface of an insulating support member 22 and a face 212 protruding from a rear surface of the support member 22. Unit area 23 are composed of a plurality of ceramic pieces 21 with respect to one unit area 23, and are arranged on the same plane of the ceramic sheet 2 and apart from each other via the insulating support member 22.

Moreover, the support member 22 in the fifth embodiment of the present invention is configured of insulating resin superior in flexibility which is capable of elastically deflecting, in addition to having fire retardancy, thermal resistance or thermal conductivity. For example, preferably it is composed of synthetic resin such as urethane based elastomer, or olefin based elastomer, or the like.

According to the above, the ceramic sheet 2 in the fifth embodiment of the present invention can be deflected by the elastic force of the support member 22. Therefore, as is shown in FIG. 7, even if the electrode plates 301 to 303 are formed so as to curve to a large extent, the ceramic sheet 2 can be deformed along the surface of the electrode plates 301 to 303, and ensure to make the protruding portion of the ceramic pieces 21 contact with respect to the electrode plates 301 to 303.

In all of the second to fifth embodiments shown in FIG. 5 to FIG. 7, the unit areas 23 are sectioned by a boundary region 24 composed of insulating support member 22. Therefore, in a case the plurality of electrode plates 301 to 303 are arranged on the same plane according to an arrangement pattern of the plurality of unit areas 23, the short circuit of these electrode plates 301 to 303 is prevented, and an interval t between these electrode plates 301 to 303 are narrowed similar to the first embodiment.

Moreover, in these second to fifth embodiments shown in FIG. 5 to FIG. 7, similar to the first embodiment, the ceramic sheet 2 and the electrode plates 301 to 303 are capable of being separated and detached by the retainer plates 4.

Figure 8:
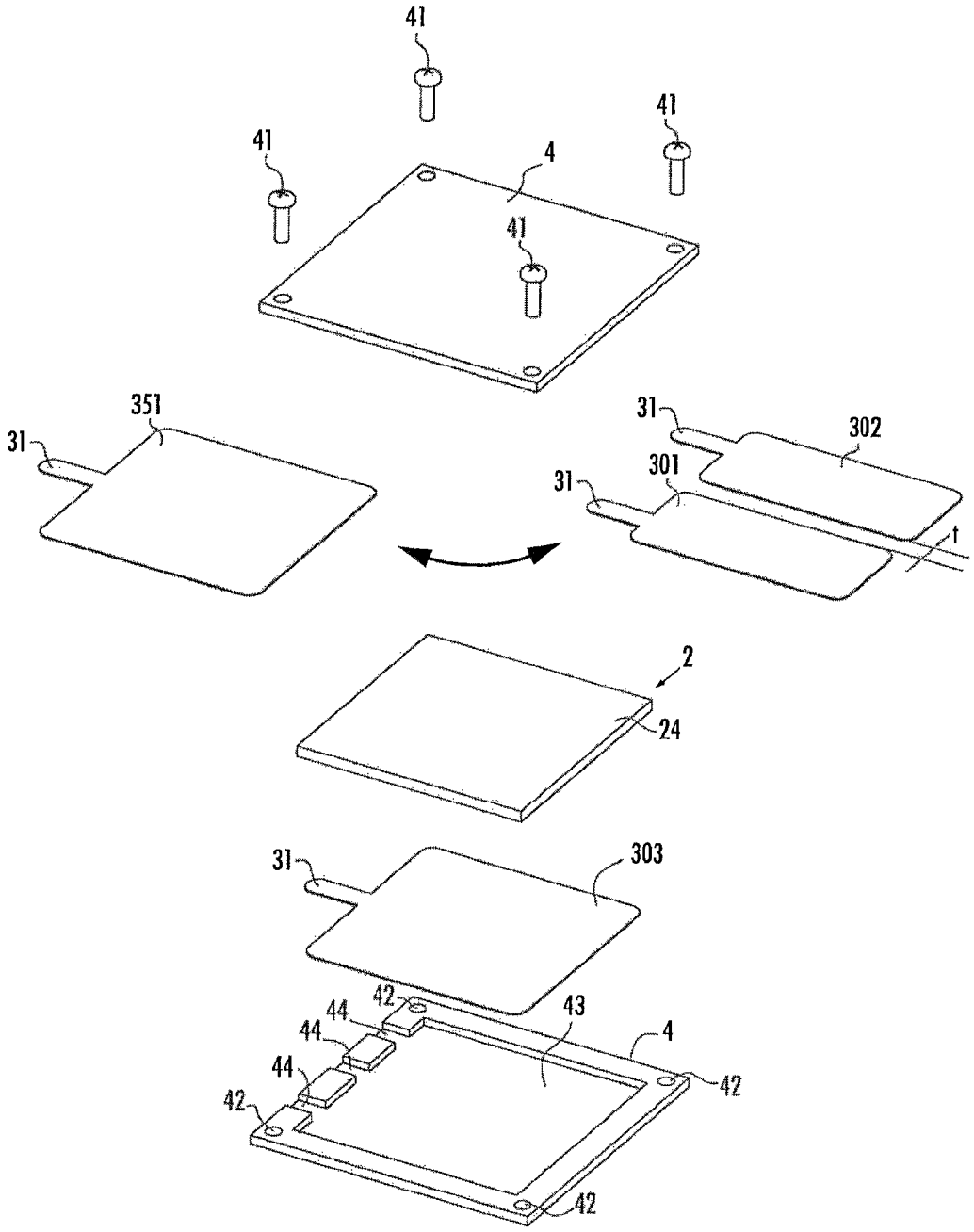
FIG. 8 is an explanatory view showing a non-linear resistive element of a sixth embodiment of the present invention.

By doing so, when it is desirable to change the electric characteristic of the non-linear resistive element 1, or in a case the performance of the ceramic sheet 2 degrades, it is able to easily exchange the ceramic sheet 2 or the electrode plates 301 to 303 of the non-linear resistive element main body. For example, in a case the ceramic sheet 2 fails or the like, it can be exchanged to a new ceramic sheet 2, or can be exchanged to a ceramic sheet 2 with a different form as shown in the other embodiments. Moreover, it can be exchanged to a conventional ceramic sheet 2 composed of a ceramic sintered compact which is sintered integrally. Even in such case, as the sixth embodiment shown in FIG. 8, a single terminal and multiple terminals of the electrode plates 301 to 303 can be easily exchanged or the like. Therefore, it is able to obtain the effect of the present invention that changing and assembling of the non-linear resistive element 1 can be easily done.

The embodiments of the present invention have been explained with reference to the drawings. However, the present invention is not limited thereto. For example, in the first to fifth embodiments shown in FIG. 1 to FIG. 7, the ceramic pieces 21 are arranged with regularity. However, they may be arranged irregularly. The shape of the ceramic sheet 2 is not limited to a rectangular shape, and can be arbitrarily changed according to the intended use to a circular shape or the like.

EXPLANATION OF REFERENCE SIGNS

1 . . . non-linear resistive element, 2 . . . ceramic sheet, 21 . . . ceramic piece, 23 . . . unit area, 24 . . . boundary region, 301-303 . . . electrode plates, 4 . . . retainer plate

The invention claimed is:

1. A non-linear resistive element comprising, at least a ceramic sheet configured by a plurality of ceramic pieces composed of ceramic sintered compact, and a sheet-like support member composed of insulating material and which supports each of the plurality of the ceramic pieces, one or the plurality of the ceramic pieces configure each of a plurality of conductive paths which penetrate the ceramic sheet in a thickness direction thereof, and the ceramic pieces configuring both ends of the conductive paths are partially exposed from the support member, wherein each of the plurality of the ceramic pieces is supported by the support member in a state in which the plurality of the ceramic pieces are sectioned and arranged in each of a plurality of unit areas which are apart from each other.

2. The non-linear resistive element according to claim 1, wherein the non-linear resistive element comprises a plurality of electrode plates arranged on one or both of a pair of main faces of the ceramic sheet, in a state electrically conducted with a single or a plurality of the ceramic pieces arranged in each of the plurality of the unit areas, and apart from each other across a boundary region between different unit areas among the support member.

3. The non-linear resistive element according to claim 2, in which the electrode plates are arranged on each of the pair of main faces of the ceramic sheet, comprising, a pair of insulating retainer plates arranged on each face of the electrode plates at an opposite side of a face of the electrode plates contacting the ceramic sheet, and a switching element which is electrically conducted with the ceramic pieces arranged in the plurality of the unit areas to which each of the plurality of the electrode plates corresponds, and which switches between a sandwiched state in which the ceramic sheet and the pair of the electrode plates contacting each of the pair of the main faces thereof are sandwiched between the retainer plates, and a detached state in which the ceramic sheet and the pair of the electrode plates contacting each of the pair of the main faces thereof are detached from the retainer plates.

* * * * *